US011141846B2

(12) United States Patent
Arbuckle et al.

(10) Patent No.: US 11,141,846 B2
(45) **Date of Patent: *Oct. 12, 2021**

(54) WALL PUNCH ASSEMBLY AND METHODS OF USE

(71) Applicants: William Arbuckle, Paso Robles, CA (US); Michael Van Horst, Fresno, CA (US)

(72) Inventors: William Arbuckle, Paso Robles, CA (US); Michael Van Horst, Fresno, CA (US)

( * ) Notice: Subject to any disclaimer, the term of this patent is extended or adjusted under 35 U.S.C. 154(b) by 13 days.

This patent is subject to a terminal disclaimer.

(21) Appl. No.: 16/271,670

(22) Filed: Feb. 8, 2019

(65) Prior Publication Data

US 2019/0202044 A1 Jul. 4, 2019

Related U.S. Application Data

(63) Continuation-in-part of application No. 15/390,312, filed on Dec. 23, 2016, now Pat. No. 10,328,557, (Continued)

(51) Int. Cl.
*B25C 3/00* (2006.01)
*B25C 1/02* (2006.01)
(Continued)

(52) U.S. Cl.
CPC ..... *B25C 3/006* (2013.01); *A47G 1/16* (2013.01); *A47G 1/205* (2013.01); *B25C 1/02* (2013.01)

(58) Field of Classification Search
CPC ..... B25C 9/00; B25C 7/00; B25C 3/00–008; B25C 1/02; A47G 1/205; A47G 1/16;
(Continued)

(56) References Cited

U.S. PATENT DOCUMENTS 304,618 A * 9/1884 Cullen ..... B25D 1/04 81/23
1,702,095 A * 2/1929 Solheim ..... B27F 7/02 227/76

(Continued)

FOREIGN PATENT DOCUMENTS

CN 2086651 10/1991
DE 19501383 C3 9/1998

OTHER PUBLICATIONS

English Abstract of DE19501383 retrieved on Jun. 9, 2015 from: "https://worldwide.espacenet.com/publicationDetails/biblio?II=0&ND=3&adjacent=true&locale=en_EP&FT=D&date=19960411&CC=DE&NR=19501383A1&KC=A1".

(Continued)

*Primary Examiner* — Joshua G Kotis
(74) *Attorney, Agent, or Firm* — Sierra IP Law, P.C.; Mark D. Miller

(57) ABSTRACT

The present invention includes devices and methods that assist in hanging pictures or other things in a desired position on a wall or other surface where it is desired to insert two or more mounting nails or studs. Embodiments of the invention include a pair of nail-inserting punch assemblies that are provided on one or more stabilizing bars, although other embodiments may include more than two punch assemblies. Preferred embodiments may also include a measuring strip (ruler) between the punch assemblies, a slidable level, a slidable nail or stud carrier, and/or a laser. The unique nail insertion mechanism of each punch includes a sleeve for receiving a finishing nail, a magnet for holding the nail in place, and a coil spring for maintaining the handle in striking position. After positioning the device on a wall, applying punching force to each handle collapses the spring and causes a nail to be driven into the wall.

18 Claims, 11 Drawing Sheets

Related U.S. Application Data which is a continuation-in-part of application No. 29/584,846, filed on Nov. 17, 2016, now Pat. No. Des. 819,465.

(60) Provisional application No. 62/308,092, filed on Mar. 14, 2016.

(51) Int. Cl.
*A47G 1/16* (2006.01)
*A47G 1/20* (2006.01)

(58) Field of Classification Search
CPC ..... A47G 1/164; A47G 1/202; B25D 5/00; B25D 1/16; B25D 1/04; B25D 1/06; B25H 7/04; B25H 7/045; B25F 5/021–024; B27F 7/07; B27F 7/006
USPC ..... 227/110, 111, 113, 147; 33/613, 626, 33/451; 81/23, 24
See application file for complete search history.

(56) References Cited

U.S. PATENT DOCUMENTS 2,798,220 A * 7/1957 Welty ..... B25C 1/02 227/139
3,101,478 A * 8/1963 Oussani ..... B65B 51/05 227/76
4,667,747 A * 5/1987 Falls ..... B25C 3/008 173/90
4,925,082 A * 5/1990 Kim ..... B25C 5/025 227/120
5,069,411 A 12/1991 Murphy
5,103,573 A 4/1992 Ehling et al.
5,103,574 A 4/1992 Levy
5,261,588 A * 11/1993 Lin ..... B25C 7/00 227/110
5,520,318 A 5/1996 Sloop
5,626,275 A * 5/1997 Chen ..... B25C 5/0214 227/110
6,029,362 A 2/2000 Miodragovic
6,421,928 B1 * 7/2002 Miller ..... A47G 1/205 33/520
6,443,348 B2 9/2002 Lamb
6,871,568 B2 * 3/2005 Chen ..... B25C 1/02 227/113
6,951,153 B2 * 10/2005 Berthlaume ..... B25C 3/006 81/177.2
6,971,184 B2 12/2005 Prevost
7,155,840 B1 1/2007 Carbonaro
7,210,243 B2 5/2007 Schmidt et al.
7,775,412 B2 * 8/2010 Nemeth ..... B25G 1/08 227/147
7,789,383 B2 * 9/2010 Grizzell ..... B42B 4/00 270/58.08
8,061,054 B2 11/2011 Rabin
8,286,363 B1 10/2012 Martinez
8,347,518 B1 * 1/2013 Martinez ..... A47G 1/205 33/613
D679,613 S 4/2013 Propp et al.
8,739,423 B1 6/2014 Cortum et al.
D737,109 S 8/2015 Gargallo et al.
D803,076 S 11/2017 Ulloa et al.
10,328,557 B2 * 6/2019 Arbuckle ..... B25C 1/02
2002/0095812 A1 7/2002 Newman
2005/0087668 A1 4/2005 Cismoski et al.
2006/0134375 A1 6/2006 Peterson
2006/0174504 A1 8/2006 Szmer et al.
2006/0213014 A1 * 9/2006 Manske ..... B25B 15/00 7/165
2009/0152323 A1 * 6/2009 Lin ..... B25C 7/00 227/148
2013/0333233 A1 12/2013 Esposito
2016/0354919 A1 * 12/2016 Fiala ..... B25H 1/0078
2017/0027341 A1 * 2/2017 Frazier, Jr. ..... A47G 1/205
2017/0303709 A1 10/2017 Ulloa et al.

OTHER PUBLICATIONS

English Abstract of CN2086651 retrieved on Feb. 12, 2019 from: "https://worldwide.espacenet.com/publicationDetails/biblio?II=0&ND=3&adjacent=true&locale=en_EP&FT=D&date=19911016&CC=CN&NR=2086651U&KC=U".
Hang It Perfect Easy Frame Hanging Tool (2012) http://www.amazon.com/Perfect-Frame-Hanging-Black-HIP36/dp/B005Z2700Q.
Hang It Perfect (2016) https://hangitperfect.com/HIP%20Frame%20Grouping%20Instructions%20Vertical%20and%20Horizontal.pdf.
Instahang (2012) https://www.instahang.com/.
InstaHang (2016) http://www.directionsforme.org/item/870700.
Moonshine Framing (2016) https://www.pinterest.com/pin/AU5dQZs-Eq2kmIkSXPPI2MC7E-rG35LisnrHIR2K3fwho_Sq10N_Bw/.
InstaHang (2016) http://thumbs4.ebaystatic.com/d/I225/m/mEXI5XHond2VuDwpIrpaCjQ.jpg.
Hang-O-Matic (2019) Product description retrieved on Feb. 9, 2019 from "https://www.hangomatic.com/product/hangomatic/".

* cited by examiner

WALL PUNCH ASSEMBLY AND METHODS OF USE

PRIORITY CLAIM

This is a continuation-in-part of and claims the benefit of pending U.S. patent application Ser. No. 15/390,312 filed on Dec. 23, 2016, which claims the benefit of U.S. Provisional patent application Ser. No. 62/308,092 filed on Mar. 14, 2016, and which is a continuation in part of and claims the benefit of U.S. Design patent application Ser. No. 29/584,846 filed on Nov. 17, 2016 (now Design patent No. D819465), all of which are incorporated herein in their entireties by this reference.

The present invention relates to methods and apparatus that assist in hanging pictures or other things in a desired, level position on a wall or similar surface, and more particularly to a double nail insertion tool with sliding leveling assembly and sliding punch assembly, and methods of use thereof.

BACKGROUND OF THE INVENTION

Generally, it is a difficult task for someone to position a picture, or other similar object, in a level placement on a wall when the object requires two or more mounting points. Holding the item, such as a picture, marking the spots to place the mounting studs, and inserting the studs often present problems, especially if performed by a single person. The task may require numerous attempts before a level placement is achieved, resulting in wasted time and multiple holes in the wall or other surface.

It would therefore be beneficial for homeowners, artists, home decorators, and others, to have a device that will aid them in quickly, safely and efficiently mounting objects in desired level manner without the need for another person to assist, nor the need for additional tools such as a tape measure, level, hammer, tape, etc.

SUMMARY OF THE INVENTION

The present invention makes it possible for one person to quickly, safely and efficiently hang and position objects on a wall or other similar surface requiring two or more support points by providing apparatus and methods for the insertion of two or more mounting studs (e.g., nails) into a wall or other similar surface, and placing the studs such that are level with each other. Embodiments of a basic unit of the present invention include at least two punch assemblies for inserting the mounting studs, with one or both of the assemblies being movably provided on one or more stabilizing bar(s). It is to be appreciated that embodiments of the invention may include more than two punch assemblies. Each punch assembly resembles a stapler, and includes a large handle that is pivotally attached at one end to a base. The base of each punch assembly may be movably mounted to the one or more stabilizing bar(s). In alternative embodiments, one of the punch assemblies may be fixedly mounted to one end of a stabilizing bar.

In preferred embodiments, one of the punch assemblies may be fixed to the proximal end(s) of the one or more stabilizing bars, with the distal end(s) of the bar(s) attached to a hand grip and/or handle, thereby forming a frame. In these embodiments, the other punch assembly is free to slide along the one or more stabilizing bars to allow the user to choose an appropriate spacing between the mounting studs to be inserted. Other embodiments of the device may include a third slidably mounted punch assembly deployed between the first two, if desired.

A key element of each punch assembly is the large, pivotally attached handle. Embodiments of the handle allow for driving the studs into the wall by pivoting about the stabilizing bar and providing the necessary impact for inserting the stud when a force is applied to the free end of the punch assembly handle. A secondary benefit is that all nails or studs may be placed with the head protruding at a desired (preferably identical) distance out from the wall, and at a desired angle for precision positioning.

Embodiments of the nail insertion mechanism, which is located opposite the pivoting end of each punch assembly, include a sleeve for receiving a stud or nail, a magnet for holding the nail or stud in place, and a coil spring for maintaining the handle in striking position. Applying force to the punch assembly handle collapses the spring and drives a nail or stud into a wall. A key benefit is that the system is designed to insert a nail to an exact distance of the nail head to the wall and at a desired angle.

Embodiments of the dual nail insertion device of the present invention may include a strip with optional measuring indicia (e.g., a ruler) between the punch assemblies to allow for precise and repeatable placement of the nails. Such a measuring strip may be placed parallel to the one or more stabilizing bar(s), but is preferably near or incorporated into the stabilizing bar adjacent to the nail insertion mechanism of each punch.

In embodiments of the invention, a sliding bubble level may be attached to the stabilizing bar for the purpose of providing properly aligned (i.e., level) nails. For more precise leveling, and to allow for the use of reference(s) to other objects on or near the wall, a laser pen may be attached to the frame, such as, for example, at one or both ends of the tool.

In embodiments of the invention, the pivoting handle of each punch assembly may have openings to allow the user to view the measurements on the ruler to confirm placement of a nail before it is inserted. These openings may include magnified lenses to assist in such viewing.

In embodiments of the invention, an extension may be provided on one or more of the handles of the punch assemblies to provide additional torque when inserting a nail into a wall. In embodiments of the invention, the hand grip at one end of the frame may extend out from (i.e., perpendicular to) the wall or other surface to facilitate easy movement and adjustment of the device.

BRIEF DESCRIPTION OF THE DRAWINGS

The various advantages of this invention may be more fully appreciated when considered in conjunction with accompanying drawings.

DETAILED DESCRIPTION

Figure 1:
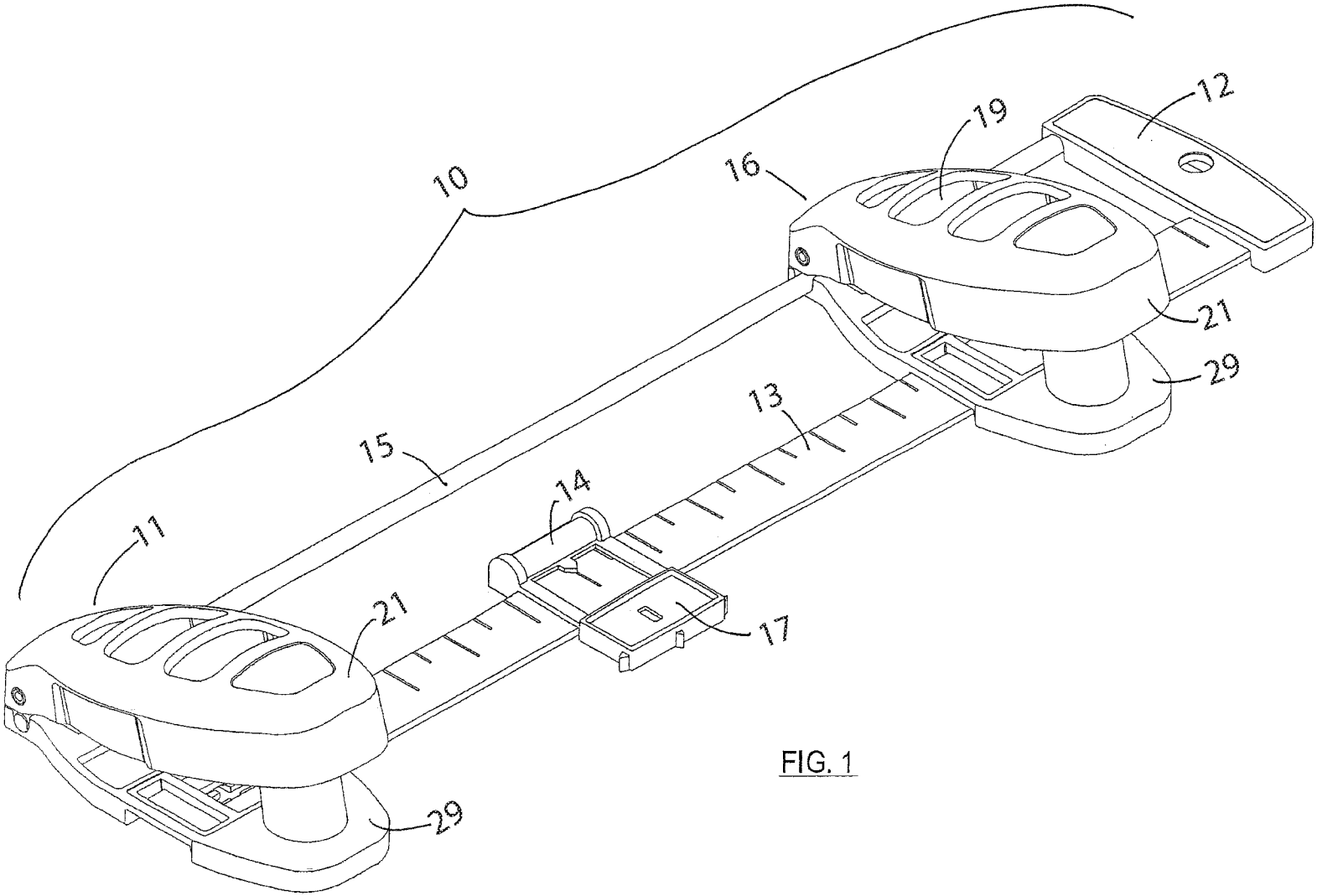
FIG. 1 is a top perspective view of an embodiment of the invention showing the supporting frame with optional ruler, fixed punch assembly, sliding punch assembly, optional magnetized nail tray, and bubble level assembly.
Figure 2A:
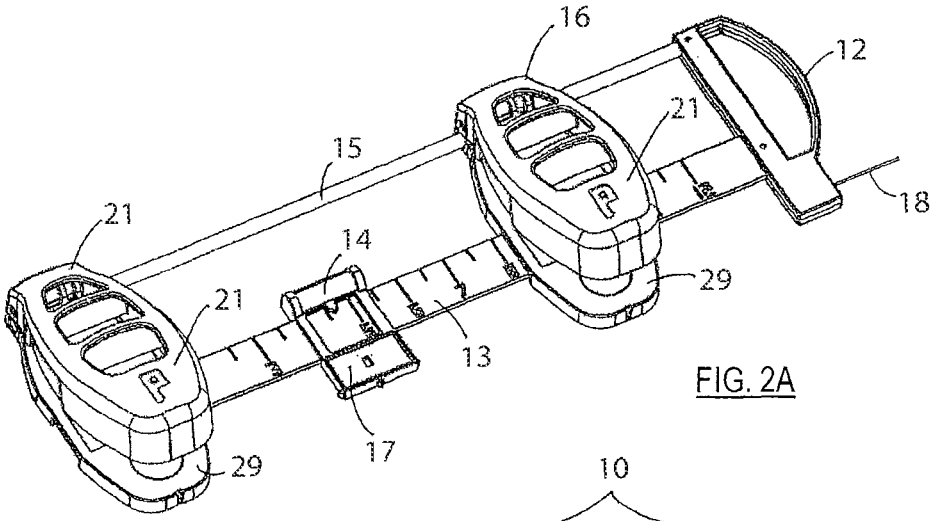
FIG. 2A is another top perspective view of an embodiment of the invention.
Figure 2B:
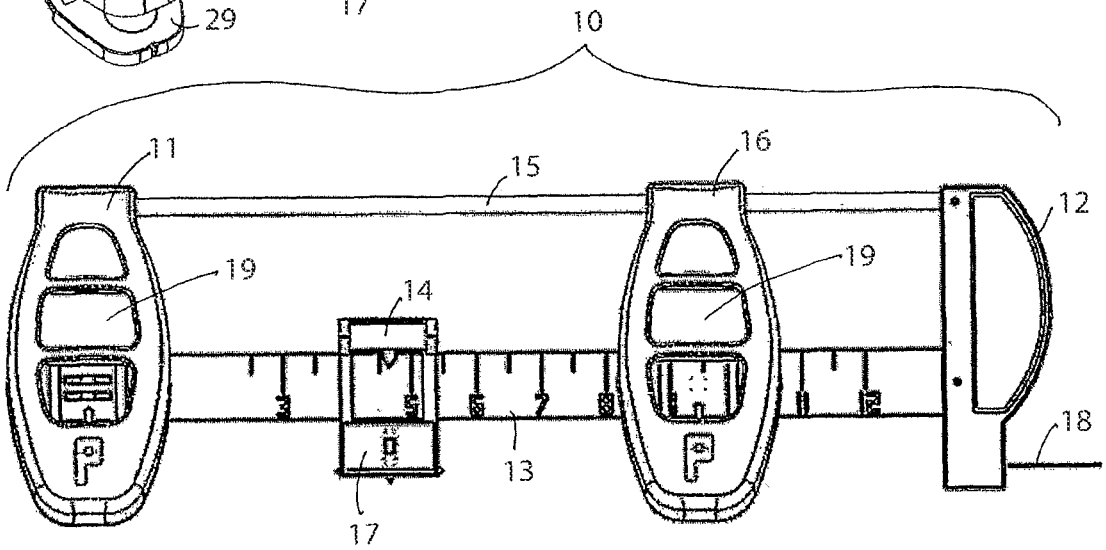
FIG. 2B is a top plan view of the embodiment of FIG. 2A.
Figure 3:
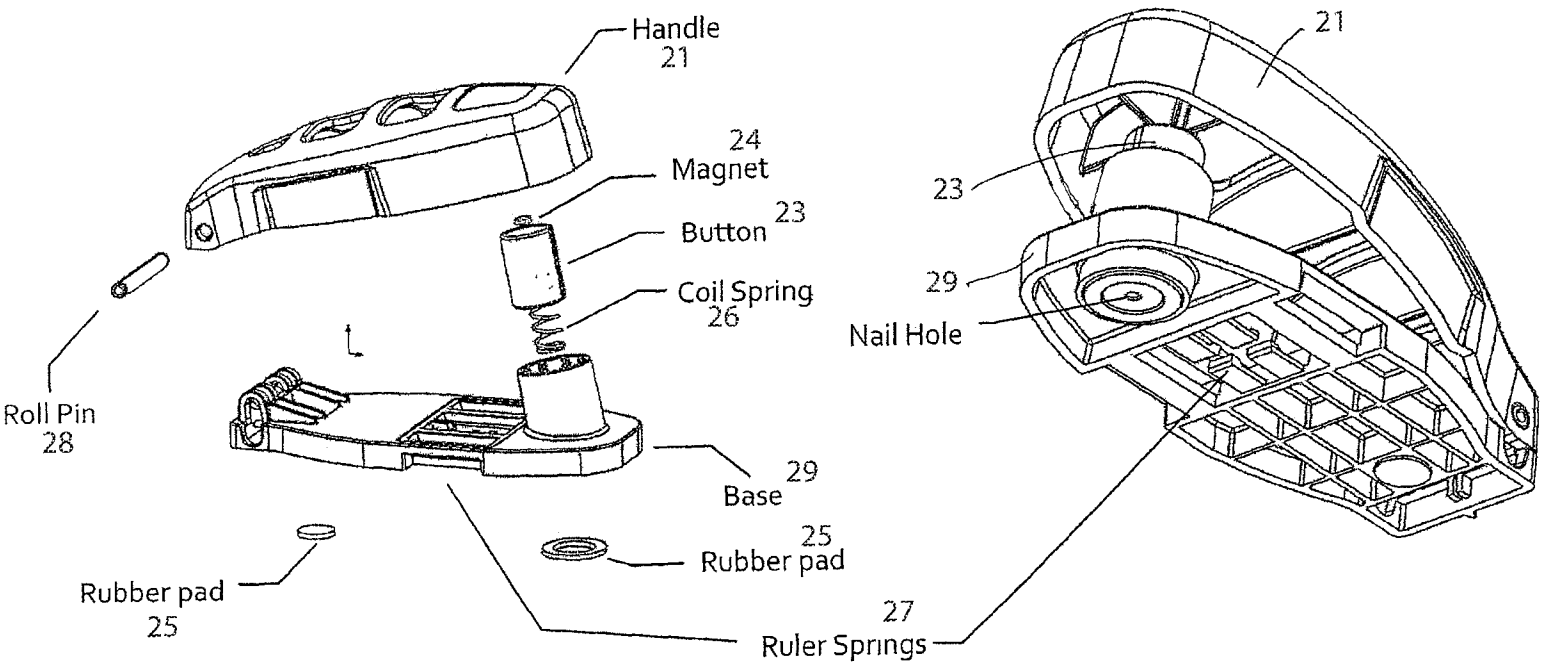
FIG. 3 is an exploded view and a constructed view of an embodiment of a punch assembly of the invention including a handle, base, and elements of an embodiment of a nail holding unit that includes button assembly, magnet, anvil, and coil spring.
Figure 4:
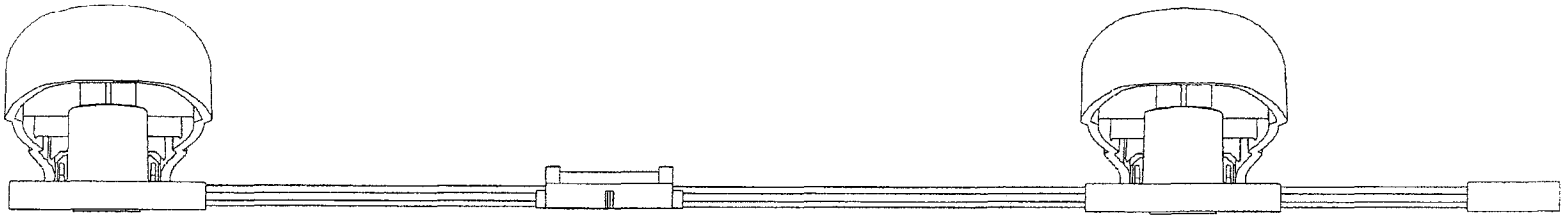
FIG. 4 is a side view of an embodiment of the present invention.
Figure 5:
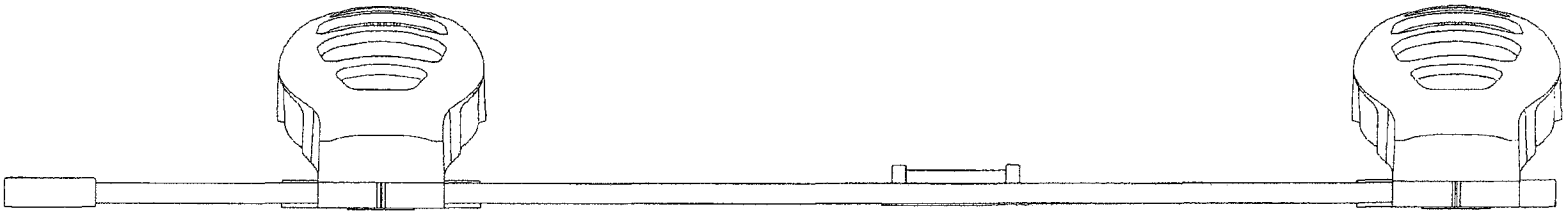
FIG. 5 is an opposite side view of an embodiment of the present invention.
Figure 7:
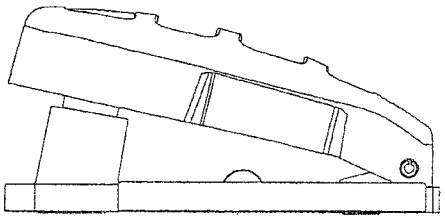
FIG. 7 is an opposite end view of an embodiment of a punch assembly of the present invention.
Figure 6:
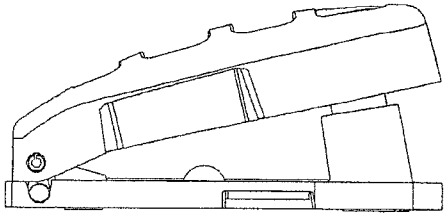
FIG. 6 is an end view of an embodiment of a punch assembly of the present invention.

Referring to the drawings wherein like reference characters designate like or corresponding parts throughout the several views, and referring first to FIGS. 1-3, it is seen that this exemplary illustrated embodiment includes a frame 10 having a first punch assembly 11 fixed at one end thereof, an end section that includes a handle 12 at the opposite end thereof, a connecting member 13 provided between the fixed punch assembly 11 and the end handle 12, and a second connecting member 15 provided in parallel with connecting member 13 between punch assembly 11 and end handle 12. In this exemplary illustrated embodiment, connecting member 13 is flat and connecting member 15 is a cylindrical rod, but other configurations may also be used for these connecting members. A second slidable punch assembly 16 is provided on frame 10 that is movable along member 13 and rod 15 between the fixed punch assembly 11 and end handle 12. In the illustrated embodiment, the connecting member 13 is in the form of an optional ruler that allows measurement alignment, and which supports a sliding bubble level assembly 14. It is to be appreciated that in other embodiments (not illustrated) both punch assemblies 11, 16 may be movable along member 13.

The fixed punch assembly 11 and the sliding punch assembly 16 of the embodiment of FIGS. 1-3 provide for a sturdy frame and variable-position insertion of nails or studs, using the punch handles 21 for impact on the nails 20 to be inserted. Each punch assembly 11, 16 includes a base 29 having an opening 30 thereon allowing the punch assembly to be slidably moved along connecting member 13. In many embodiments, the first punch assembly 11 is fixedly attached to connecting member 13, and the second punch assembly 16 is movable along member 13; in other embodiments, both assemblies 11, 16 are movable along member 13. The illustrated sliding bubble level assembly 14 is provided on connecting member 13 for proper leveling. An optional nail tray 17, which may be magnetic, may be provided with or as part of assembly 14 located on connecting member 13. An optional laser 18 may be provided for more precise leveling and, when needed, alignment with other references located at a distance on a wall. Apertures 19 may be provided in the handles 21 of the punch assemblies 11 and/or 16 in order to allow for viewing (which may include magnification) through the punch assemblies for more accurate placement of nails or studs. These components may be integrated to provide the user all of the necessary elements for effective nail insertion in one complete package.

FIG. 3 shows views of an exemplary punch assembly including a handle 21 pivotally mounted to a base 29, and a mechanism for holding nails in place prior to insertion. A key component is the mechanism that holds a nail in place prior to insertion into a wall. In the exemplary embodiment of FIG. 3, the illustrated mechanism includes a button assembly 23 having a bore 22 therein for tightly holding a nail or stud 20, a magnet 24 for holding a metallic nail or stud 20 inside the button assembly 23, an optional anvil to absorb impact, and a coil spring 26 that urges the assembly to an open position for loading a nail and placement on a wall. All of these components work together to provide for a solidly held nail or stud prior to insertion. The base 29 of the sliding punch assembly 16 may include one or more spring mechanisms 27 that act against flat member 13 to hold the base 29 on member 13 at a desired location. A round roll pin 28 may be inserted into the punch assembly base 29 to allow the handle portion 21 to pivot about the punch assembly when the handle is impacted. Rubber pads 25 may also be provided underneath base 29 to prevent base 29 from damaging or scraping against the wall.

Figure 8:
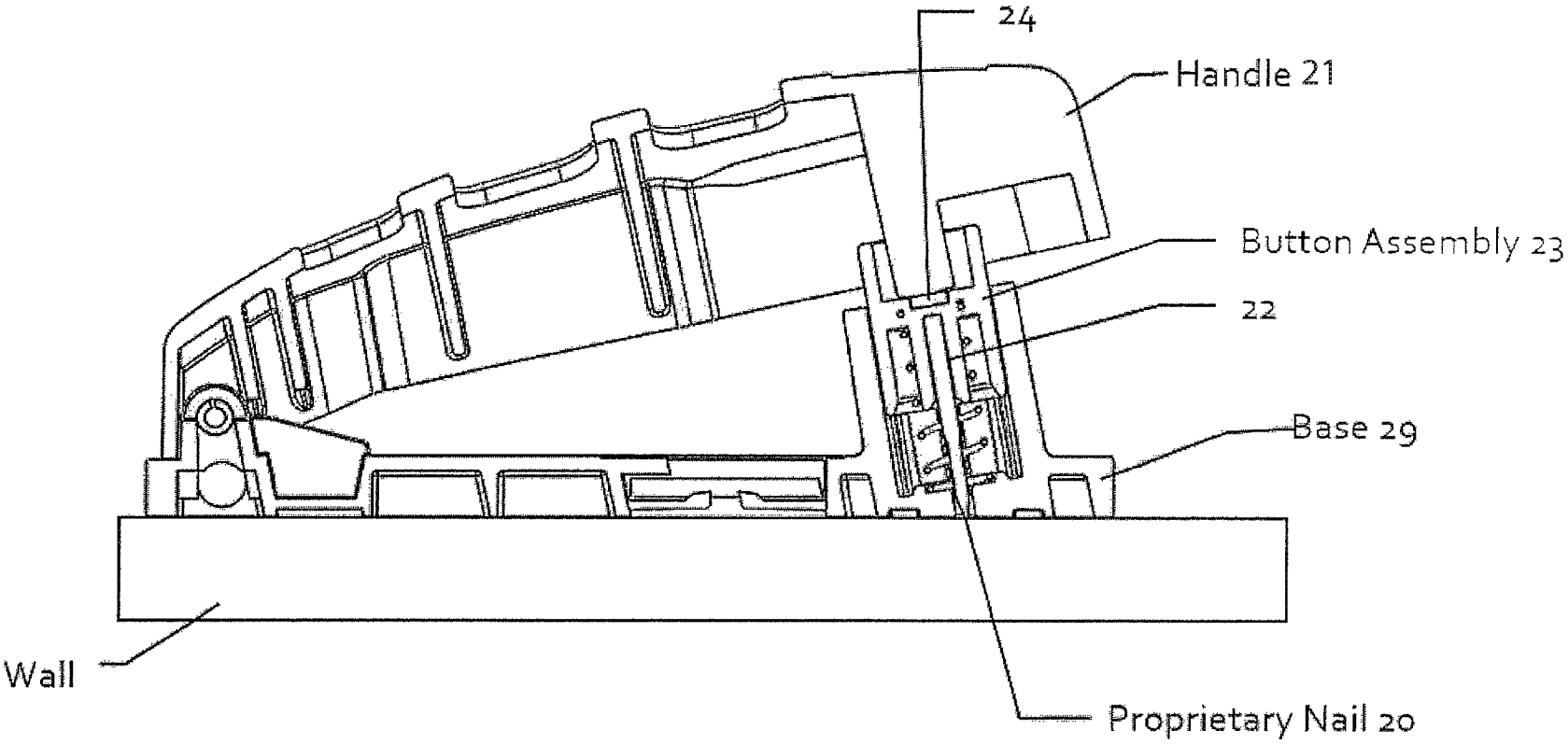
FIG. 8 is a cross-sectional side view of a punch assembly of the present invention containing a nail in position for nail insertion and the placement of the nail to be inserted.
Figure 9:
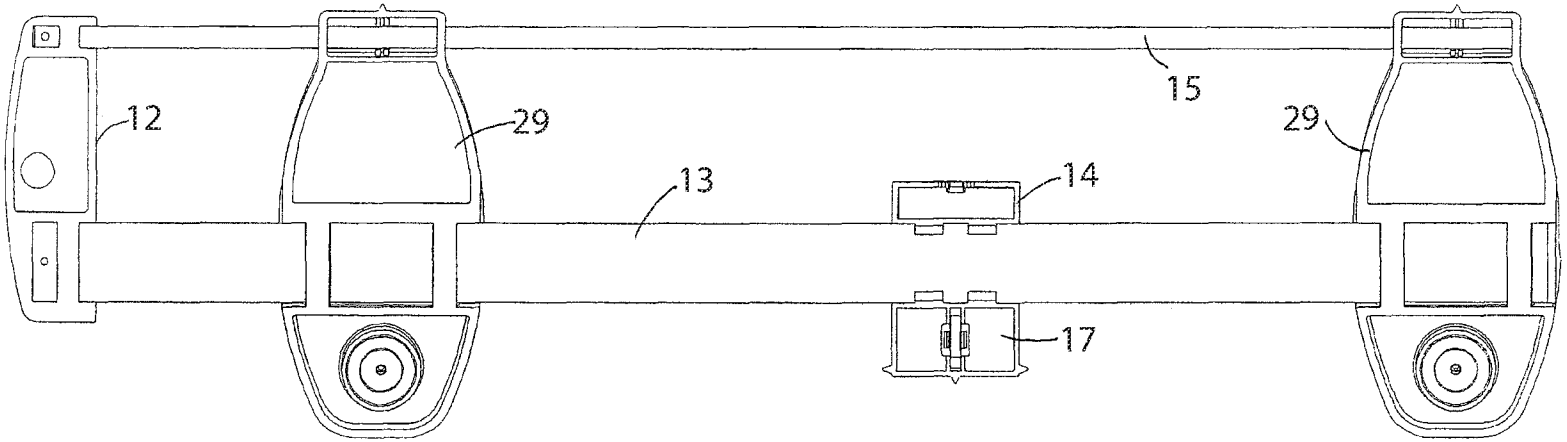
FIG. 9 is a bottom view of an embodiment of the present invention.
Figure 10:
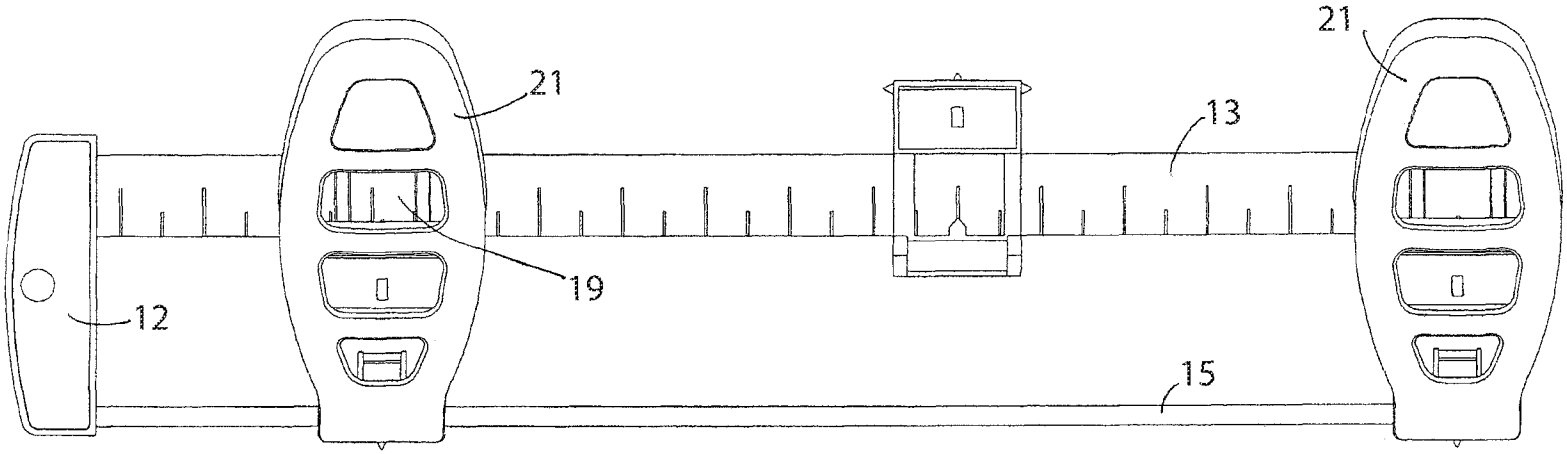
FIG. 10 is a top view of an embodiment of the present invention.
Figure 11:
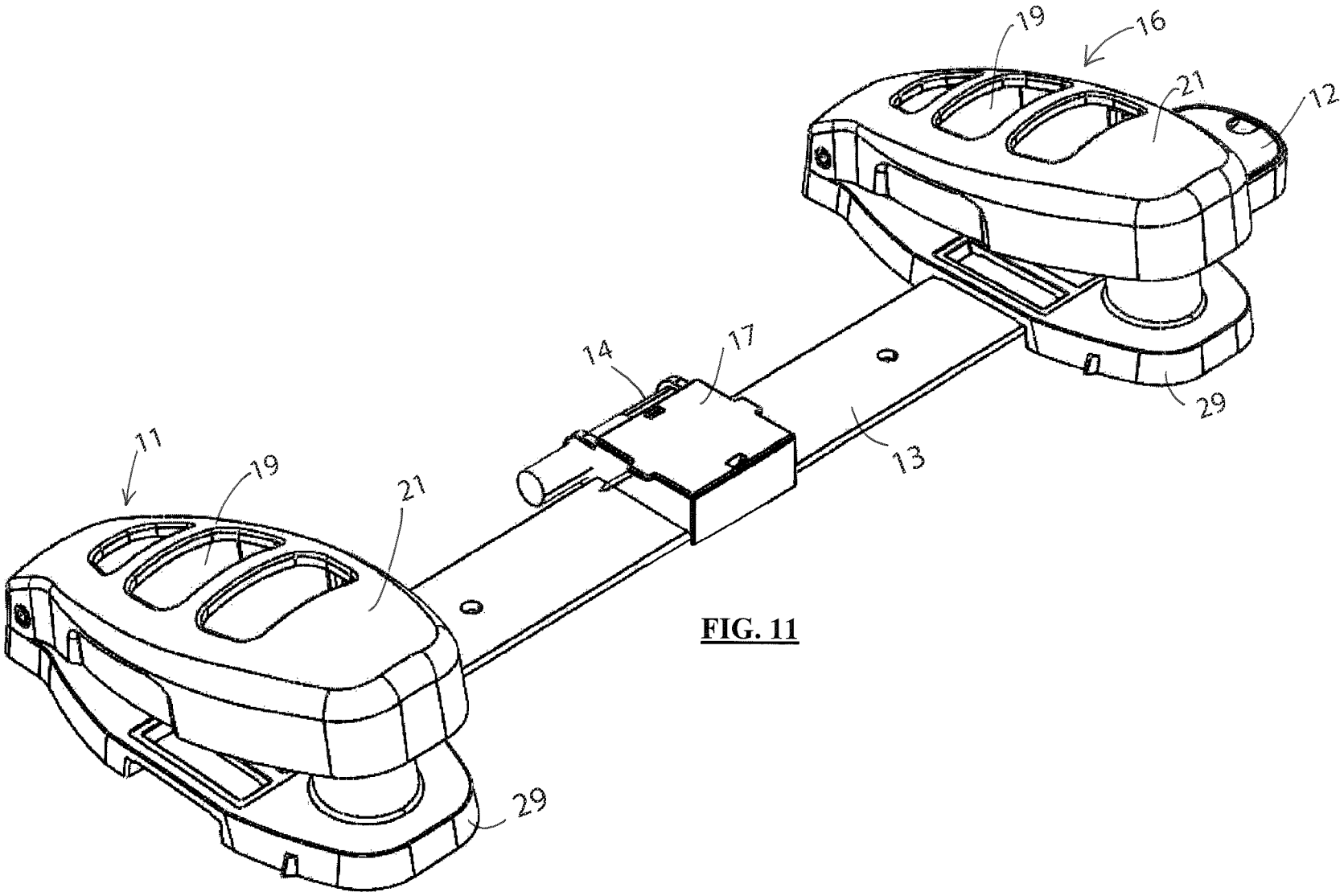
FIG. 11 is a top perspective view of an alternative embodiment of the invention.
Figure 12:
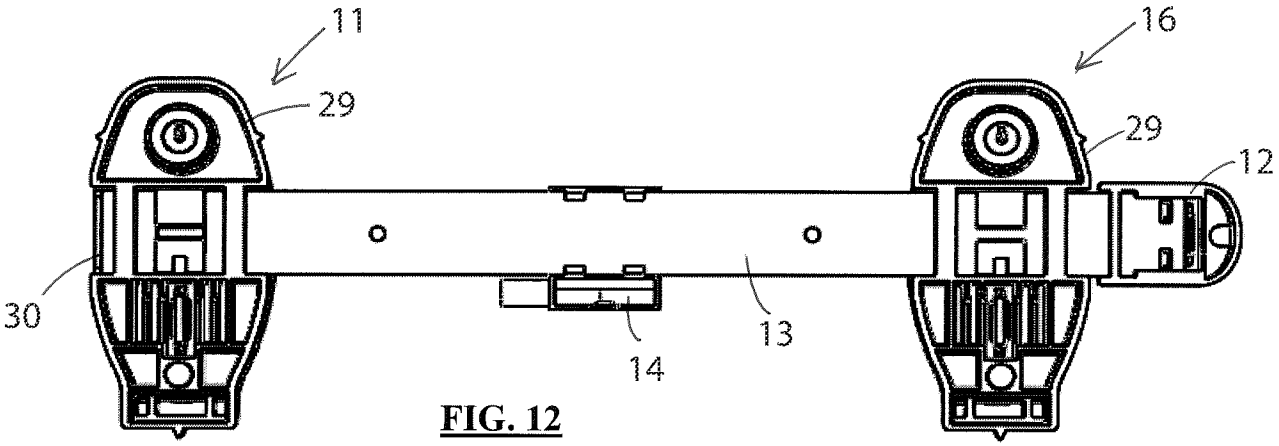
FIG. 12 is a bottom plan view of the embodiment of FIG. 11.
Figure 13:
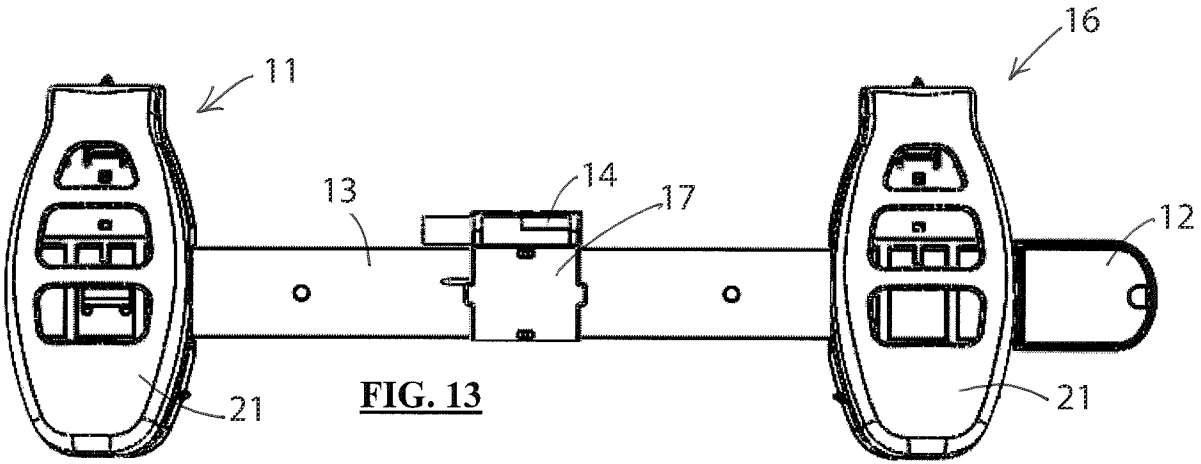
FIG. 13 is a top plan view of the embodiment of FIG. 11.
Figure 14:
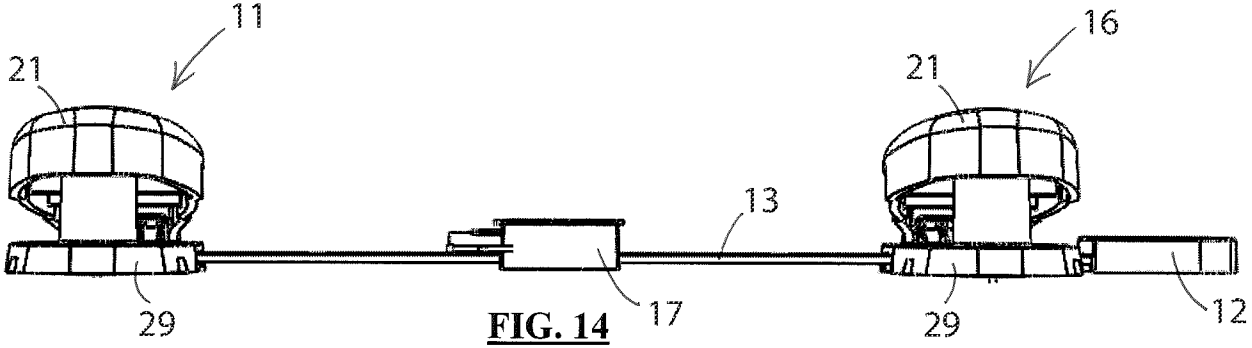
FIG. 14 is a side elevational view of the embodiment of FIG. 11.
Figure 15:
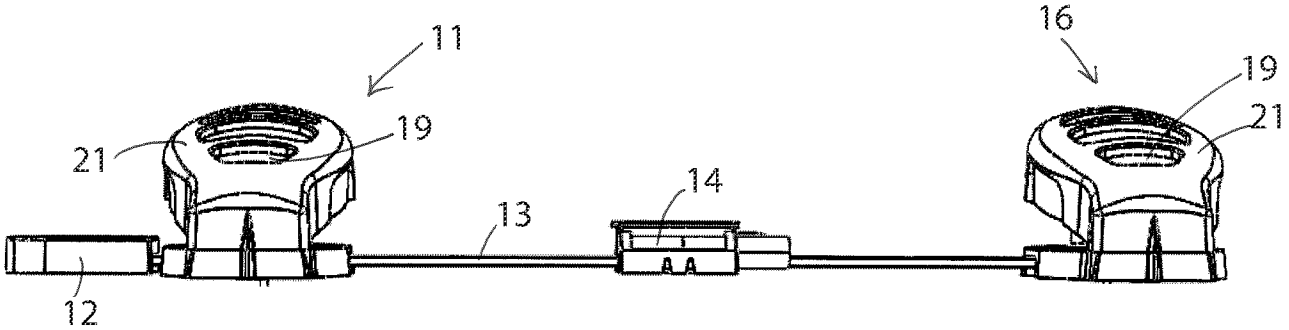
FIG. 15 is an opposite side elevational view of the embodiment of FIG. 11.
Figure 16:
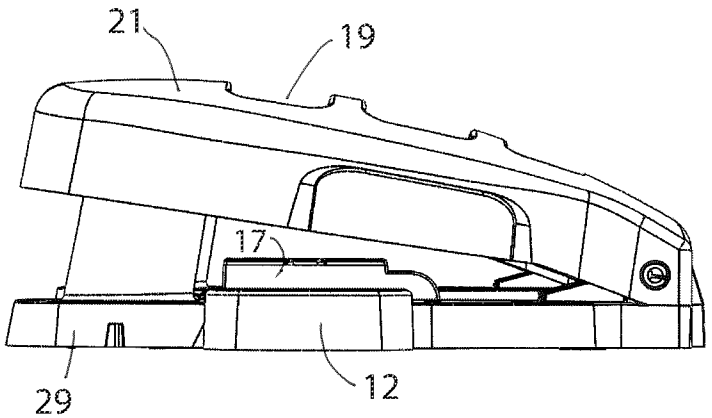
FIG. 16 is an end view of the embodiment of FIG. 11.
Figure 17:
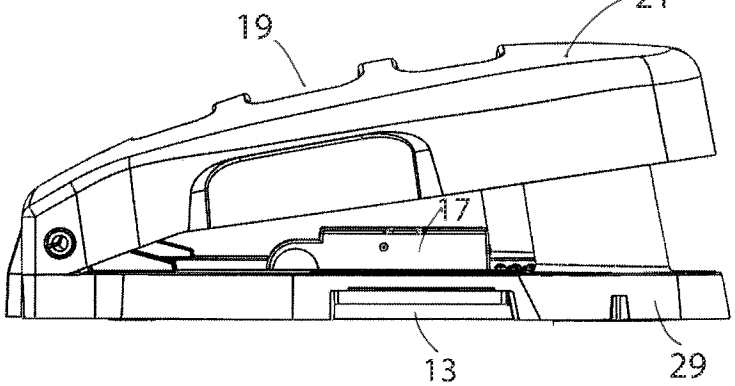
FIG. 17 is an opposite end view of the embodiment of FIG. 11.

FIG. 8 shows a cross-section of an embodiment of a punch assembly, showing the elements in place in a ready-to-go position prior to inserting a nail or stud 20. Applying force to the handle 21 of the punch assembly provides the necessary impact to insert the nail. The button assembly 23, with magnet 24, bore 22, spring 26 and base 29 form a system for holding the nail or stud 20 in place prior to its insertion into a wall. The spring holds back the handle and the magnet holds the nail in place until impact. After impact, the spring pushes the handle back to its pre-impact position.

Referring to the alternative embodiment illustrated in FIGS. 11-17, it is seen that this embodiment also includes a first punch assembly 11 provided at one end of a connecting member 13, and a handle 12 provided at the opposite end of the connecting member 13. In this exemplary illustrated embodiment, connecting member 13 is flat, although other configurations may also be used. A second slidable punch assembly 16 is provided that is movable along member 13 between the fixed punch assembly 11 and end handle 12. Measuring indicia may or may not be provided along member 13.

Each punch assembly includes a base 29 having an opening 30 thereon allowing each punch assembly to be slidably moved along connecting member 13. In many embodiments, the first punch assembly 11 is fixedly attached to connecting member 13, and the second punch assembly 16 is movable along member 13; in other embodiments, both assemblies 11, 16 are movable along member 13. This provides for variable-position insertion of nails or studs, using the punch handles 21 for impact on the nails/studs 20 to be inserted. An optional slidable bubble level assembly 14 may be provided along member 13 for proper leveling. An optional slidable nail tray 17 may also be provided along member 13. An optional laser 18 may be provided for more precise leveling and, when needed, alignment with other references located at a distance on a wall. Apertures 19 may be provided in the handles 21 of the punch assemblies 11 and/or 16 in order to allow for viewing (which may include magnification) through the punch assemblies for more accurate placement of nails. These components may be integrated to provide the user all of the necessary elements for effective nail insertion in one complete package.

In alternative embodiments, an extension (not shown) may be provided on each of handles 21 of the punch assemblies 11 and 16. These extensions provide a larger surface against which a user may exert force to drive a nail 20 into a wall. In some embodiments, these extensions may connect together so that the user may insert both nails by imparting a single force to both extensions.

In alternative embodiments, frame handle 12 may extend out from (i.e., perpendicular to) the wall or other surface to facilitate easy movement, adjustment and positioning of the device.

It is to be appreciated that in order to provide for clean, accurate and predictable placement and insertion of nails, the nails must be snugly secured to avoid any wobbling or side movement during the insertion process. Accordingly, embodiments of the invention include a narrow channel inside button assembly 32 for holding the nails. It is therefore to be appreciated that the nails used in most embodiments of the invention will have shafts and pointed ends, but will not necessarily have heads, since this would require a wider channel and would open the possibility of misdirected nail insertions. In other embodiments, the nails may have heads, but are preferably elongated headless shafts (e.g., finishing nails) that fit snugly in the sleeves to provide more precise insertion.

Operation of a Preferred Embodiment

In order to use either of the illustrated embodiments of the invention, nails or studs 20 are loaded into both punch assemblies 11 and 16, and slidable punch assembly 16 is positioned along stabilizing bar 13 (using the measurements of the ruler, if provided) so that the two punch assemblies are spaced apart at a selected distance. The unit is then placed against the wall or other surface, and moved until it is level according to the bubble level 14, and/or according to the optional laser 18. The user then inserts the nails/studs by applying punching force to the handles 21 of each punch assembly, thereby driving a nail or stud from each assembly into the wall. The unit is then removed from the wall or surface, and each punch assembly is then re-loaded with another nail for the next use.

It is to be appreciated that different versions of the invention may be made from different combinations of the various features described above. It is to be understood that other variations and modifications of the present invention may be made without departing from the scope thereof. It is also to be understood that the present invention is not to be limited by the specific embodiments disclosed herein, but only in accordance with the claims when read in light of the foregoing specification.

What is claimed is:

1. An apparatus for inserting nails into a flat surface comprising: a first punch assembly, a second punch assembly, and at least one elongated stabilizing member extending between said first and second punch assemblies; wherein each punch assembly comprises a base having an opening thereon through which said stabilizing member is slidably engaged, a handle pivotally attached to said base, and a nail insertion mechanism; and wherein each nail insertion mechanism comprises: a sleeve for receiving a nail, a magnet for holding the nail in place, and a coil spring for maintaining the handle away from the base such that applying punching force to the handle collapses the spring and causes a nail to forcibly exit from the nail insertion mechanism.

2. The apparatus of claim 1 wherein said at least one stabilizing member is in the form of a flat member.

3. The apparatus of claim 2 wherein a slidable level is provided on said flat member.

4. The apparatus of claim 3 wherein a nail holder is provided on said flat member.

5. The apparatus of claim 1 wherein openings are provided in each punch assembly handle to allow a user to view placement of the nail before it is driven out of the nail insertion mechanism.

6. The apparatus of claim 5 wherein said openings include at least one magnifying lens to assist in viewing.

7. The apparatus of claim 1 wherein nails used in said punch assemblies are finishing nails having no heads.

8. The apparatus of claim 1 further comprising at least one laser device attached thereto for leveling said apparatus prior to insertion of nails into a flat surface.

9. The apparatus of claim 1 further comprising at least one laser device attached at one end of said at least one stabilizing member to align the apparatus with existing nails prior to insertion of additional nails.

10. The apparatus of claim 1 further comprising a third punch assembly slidably mounted on said at least one stabilizing member between said first and second punch assemblies.

11. The apparatus of claim 1 further comprising an extension mounted on at least one of the handles of said punch assemblies.

12. A method of hanging an object on a vertically oriented wall or surface requiring two mounting points comprising the steps of:

(a) loading nails into sleeves of a device comprising at least two punch assemblies provided on at least one stabilizing bar wherein a first punch assembly is fixedly attached at one end of the at least one stabilizing bar and a handle is provided at the opposite end thereof, and wherein a second punch assembly is movably provided on said at least one stabilizing bar; wherein each punch assembly comprises a base, a handle pivotally attached to said base, and a nail insertion mechanism, and wherein said second punch assembly comprises an opening through which said stabilizing bar is slidably engaged; wherein each nail insertion mechanism comprises a sleeve of said sleeves for receiving a nail, a magnet for holding the nail in place, and a coil spring for maintaining the handle away from the base;

(b) moving the second punch assembly to a desired location along said at least one stabilizing bar relative to the first punch assembly;

(c) positioning the device at a desired location on said wall or surface; and (d) striking the handles of each of said punch assemblies to cause the nails to exit therefrom.

13. The method of claim 12 wherein said device further comprises measuring indicia on said at least one stabilizing bar, and comprising the further step of using the measuring indicia to position said second punch assembly before striking the handles of the punch assemblies.

14. The method of claim 13 wherein each punch assembly handle further comprises at least one opening having a magnifying lens therein, and comprising the further step of using said magnifying lens to position said second punch assembly before striking the handles of the punch assemblies.

15. The method of claim 12 wherein said device further comprises a level located on said at least one stabilizing bar, and comprising the further step of using the level to position the device on a surface before striking the handles of the punch assemblies.

16. The method of claim 15 wherein said device further comprises at least one laser located on said device, and comprising the further step of using the at least one laser to position the device on the wall or surface before striking the handles of the punch assemblies.

17. The method of claim 15 wherein said device further comprises a third punch assembly slidably mounted on said at least one stabilizing bar between said first and second punch assemblies.

18. The method of claim 15 wherein said at least one stabilizing bar comprises two stabilizing bars extending between said punch assemblies.

* * * * *